US006164098A

United States Patent [19]

Hommes

[11] Patent Number: 6,164,098

[45] Date of Patent: Dec. 26, 2000

[54] FRAMELESS GLASS DOOR LOCK

[75] Inventor: Jack L. Hommes, Zeeland, Mich.

[73] Assignee: Howard Miller Clock Company, Zeeland, Mich.

[21] Appl. No.: 09/154,321

[22] Filed: Sep. 16, 1998

[51] Int. Cl.[7] ..... E05B 65/44

[52] U.S. Cl. ..... 70/78; 70/135; 292/1; 292/258; 312/318.1; 312/215

[58] Field of Search ..... 292/258, 340, 292/1, DIG. 6; 70/78–80, 95–97, 14, 135, 136, 137, 139, 102; 312/138.1, 215

[56] References Cited

U.S. PATENT DOCUMENTS

| | | | |
|---|---|---|---|
| 790,009 | 5/1905 | Streeter | 292/258 |
| 1,845,458 | 2/1932 | Walton | 70/96 |
| 2,716,881 | 9/1955 | Terrill | 70/14 |
| 2,852,926 | 9/1958 | Chervenka . | |
| 2,878,663 | 3/1959 | Smith | 70/14 |
| 2,983,000 | 5/1961 | Metzger | 70/97 |
| 3,014,747 | 12/1961 | Nichols | 70/14 |
| 3,834,746 | 9/1974 | Hinden | 70/14 |
| 4,078,835 | 3/1978 | Spencer | 292/258 |
| 4,130,309 | 12/1978 | Lewis | 292/258 |
| 4,526,412 | 7/1985 | Gist | 292/259 |
| 4,865,248 | 9/1989 | Barth | 312/215 |
| 4,910,915 | 3/1990 | Sanchez | 70/134 |
| 5,154,459 | 10/1992 | Cochran | 292/258 |
| 5,638,906 | 6/1997 | Mc Cabe | 312/138.1 |

FOREIGN PATENT DOCUMENTS

| | | | |
|---|---|---|---|
| 286082 | 5/1966 | Australia | 70/95 |
| 1433246 | 2/1966 | France | 292/258 |
| 783386 | 9/1957 | United Kingdom | 70/95 |

*Primary Examiner*—Darnell Boucher
*Attorney, Agent, or Firm*—Warner Norcross & Judd LLP

[57] ABSTRACT

A cabinet locking system for a frameless glass door. The system includes a strike/pull mounted on the door and a lock mounted on the cabinet. The strike/pull clamps about the edge of the glass door and includes a lock strike on the cabinet-interior side and a pull on the cabinet-exterior side. The lock mounted on the cabinet frame includes a throw cooperating with the strike/pull. In the locked position, the lock throw cooperates with the strike of the strike/pull to lock the door in the closed position.

17 Claims, 3 Drawing Sheets

FRAMELESS GLASS DOOR LOCK

BACKGROUND OF THE INVENTION

The present invention relates to a cabinet lock, and more particularly to a lock for a cabinet with a frameless glass door.

Cabinets include glass doors so that the items stored in the cabinet can be displayed without opening the door. Generally, there are two types of glass doors installed in cabinets: (1) framed glass doors, having the glass framed by wood or other framing material, and (2) frameless glass doors, which lack surrounding frames. An advantage of framed glass doors is that they are compatible with conventional cabinet hardware (hinges and locks) designed for attachment with screws. A disadvantage is that a significant portion of the door is not transparent because of the frame, which partially blocks the display of the materials stored in the cabinet. Also, frames are considered by some to detract from the aesthetics of at least certain cabinet designs.

Frameless glass doors have the advantage of a transparent door without the visual obstruction of a surrounding frame. However, it is more difficult to install lock mechanisms in frameless glass doors. A typical prior art lock mechanism 10 for a frameless glass door is shown in FIGS. 1 and 2. The lock mechanism includes a lock cylinder 12 supported within the glass door and a keeper or strike 28 on the cabinet. More specifically, lock cylinder 12 extends through spacing bracket 14 in a hole (not visible) in glass door 16. Mounting nut 18 is threaded onto threads 20 and tightened against glass door 16 to hold the lock cylinder 12 in place. Lock throw 22 extends from lock cylinder 12. Key 23 rotates the lock throw 22 between an unlocked position (FIG. 1) and a locked position (FIG. 2). Lock strike plate 28 is installed on cabinet frame 26 over lock strike recess 24. In the locked position, lock throw 22 extends into lock strike recess 24 formed in cabinet frame 26. When lock 10 is locked, the strike plate 28 prevents glass door 16 from swinging open by restricting the movement of lock throw 22.

Although prior art lock 10 effectively locks the swinging door 16, it nonetheless has several disadvantages. A hole must be formed in the glass door to install the lock cylinder. The hole weakens the glass, complicates the door construction, can result in glass breakage, and undesirably increases the cost of the assembly. Further, a pull (i.e., handle) separate from the lock must be installed on glass door 16 so that an operator has a handle with which to pull open the door if the key is missing.

Cabinet manufacturers have used magnetic door stop 4 to hold glass door 34 in the closed position. (FIG. 3.) Magnetic door stop 4 is installed on cabinet frame 32. Glass door 34 is bracketed between front plate 48 and rear plate 50 of prior art pull 2. The rear plate 50 is constructed of ferrous metal. When the door 34 is closed, magnets 6 of magnetic door stop 4 engage the rear plate 50 to hold the door closed.

Although the magnetic door stop effectively holds the door closed (FIG. 3), the opening process for such an arrangement causes difficulties. A user opening the door must pull hard enough to overcome the magnetic force holding the door closed. As soon as the magnets 6 release the back plate 50, the glass door swings freely so that the user must quickly counter the force previously used to overcome the magnet holding the door closed. The user frequently overcompensates to cause the door to vibrate or rattle. Such vibration or rattling energy transfers to the attached cabinet to rattle the items on display in the cabinet. This rattling displeases the user, since the items on display can be fragile and expensive heirlooms or curios. Further, users become annoyed by having to use the precise amount of opening force to barely overcome the magnet, yet minimize rattle.

SUMMARY OF THE INVENTION

The aforementioned problems are overcome in the present invention in which a lock system for a cabinet with a frameless door (e.g., a glass door) includes a strike or keeper mounted on the door and a lock assembly mounted on the cabinet. More specifically, the strike is fitted over the edge of the door and includes a strike portion on the back of the door and preferably a pull portion on the front of the door. The lock, for example a lock with a sliding lock throw, is mounted to the cabinet frame. When in the locked mode, the lock throw extends from the lock into the lock strike to lock the door in the closed position.

The lock assembly of the present invention provides several advantages. The lock assembly does not require forming a hole in the glass. Further, the strike/pull can be located at any position along the glass door edge so that the strike can be precisely positioned with respect to the lock. In the preferred embodiment, the strike/pull includes an integral pull, which eliminates the need to install a pull separate from the strike. The lock assembly permits the use of a variety of throw locks, such as a sliding bolt lock, which is a popular lock mechanism for wood-framed doors. Finally, once the lock assembly is unlocked, a users can freely and smoothly swing the door open without having to overcome any magnetic or other force that may cause the door and cabinet to rattle.

These and other objects, advantages, and features of the invention will be more readily understood and appreciated by reference to the detailed description of the preferred embodiment and the drawings.

DETAILED DESCRIPTION OF THE PREFERRED EMBODIMENT

Figure 5:
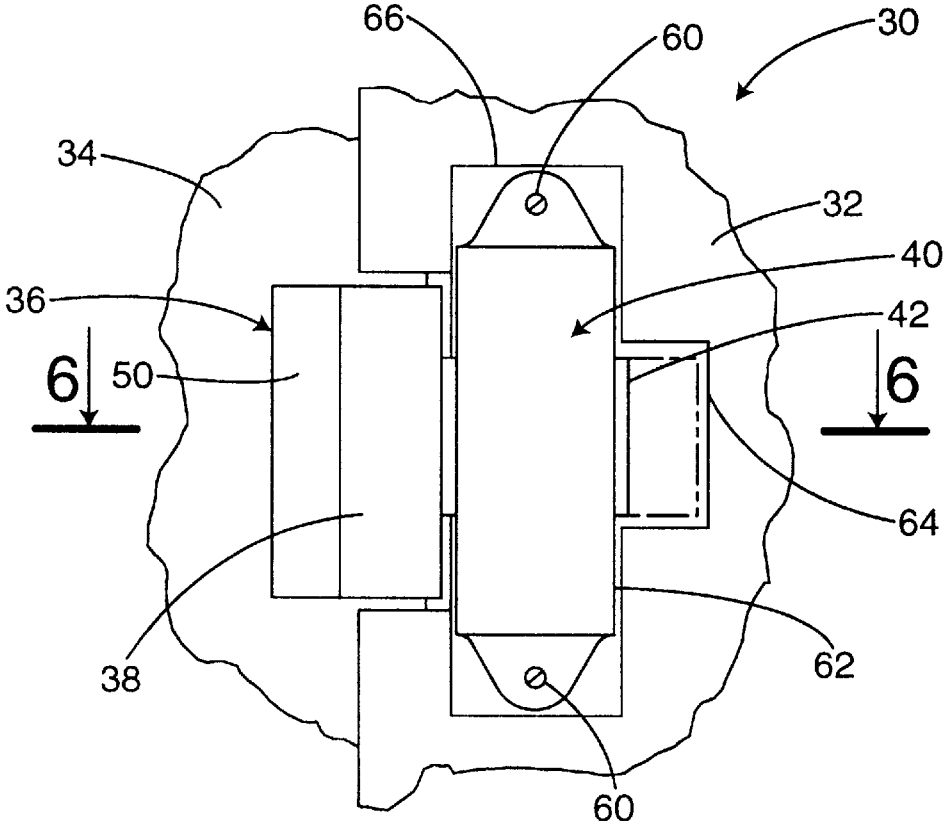
FIG. 5 is a rear view of a cabinet having the combined lock and strike/pull of the present invention in the closed and locked position.
Figure 6:
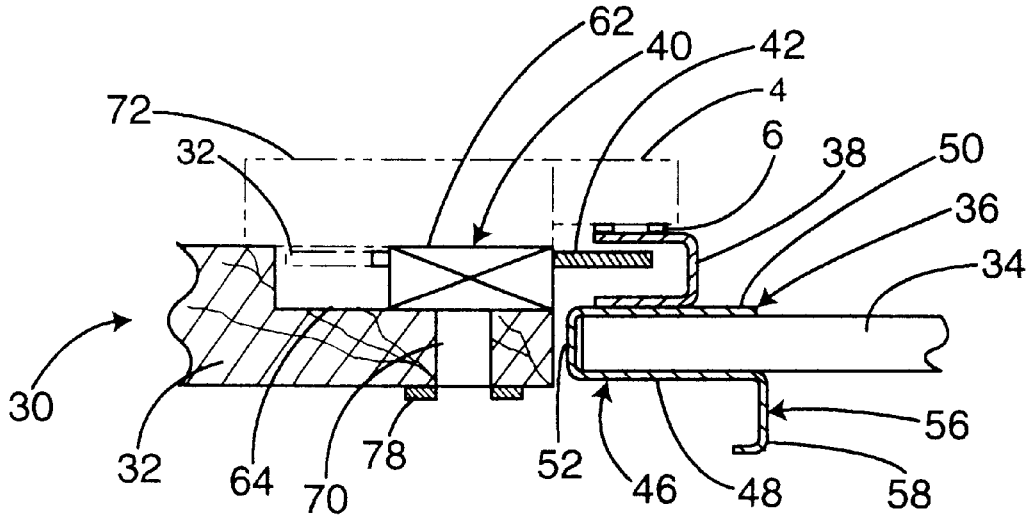
FIG. 6 is a sectional view taken along the line VI—VI of FIG. 5.
Figure 7:
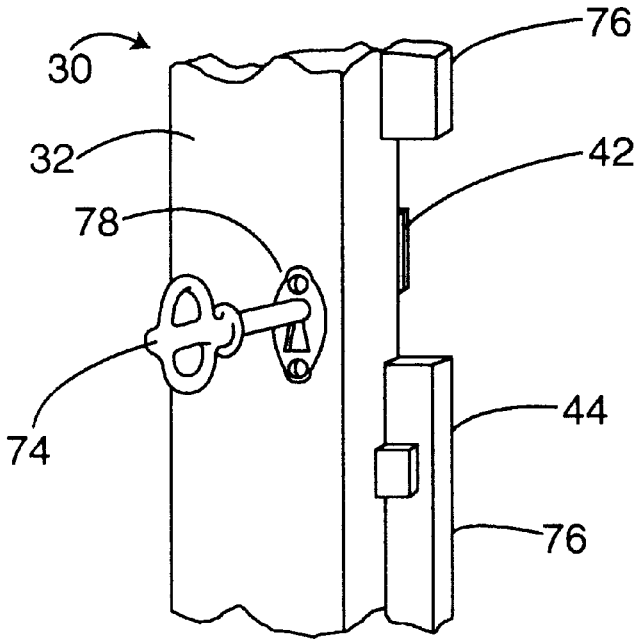
FIG. 7 is a front perspective view of the cabinet frame of FIG. 5 showing the lock in the unlocked position and the door (not shown) in the open position.

The cabinet 30 of the present invention includes cabinet frame 32 and door 34 hingedly mounted to the cabinet frame. (FIGS. 5–7.) Strike/pull 36 clamps about the edge of door 34. Strike/pull 36 includes lock strike 38 attached to the door-interior side of pull 36. Lock 40 is mounted to cabinet frame 32 and includes a lock throw 42 that can extend in the lock mode to engage lock strike 38. Door stop 44 is mounted to cabinet frame 32 to provide a means for positioning door 34 in the closed position.

Cabinet 30 can be any type of furniture or fixture in which a door is installed, including without limitation, armoires, wardrobes, display cabinets, and cupboards. All such constructions are well know to those skilled in the art and will not be described in detail. Cabinet 30 includes cabinet frame 32. Cabinet frame 32 is made of any suitable structural material, such as wood, metal, and plastic. Cabinet frame 32 may include lip 76 (FIG. 7) to improve the appearance.

Cabinet door 34 is mounted to cabinet frame 32 using hinges (not shown). Cabinet as door 32 is also made of any suitable structural material, such as wood, metal, plastic, and glass. In the preferred embodiment, door 34 is glass and is mounted using glass-door hinges (not shown), as is known in the art. Preferably, door 34 is mounted to cabinet frame so that door 34 swings horizontally to open.

Figure 1:
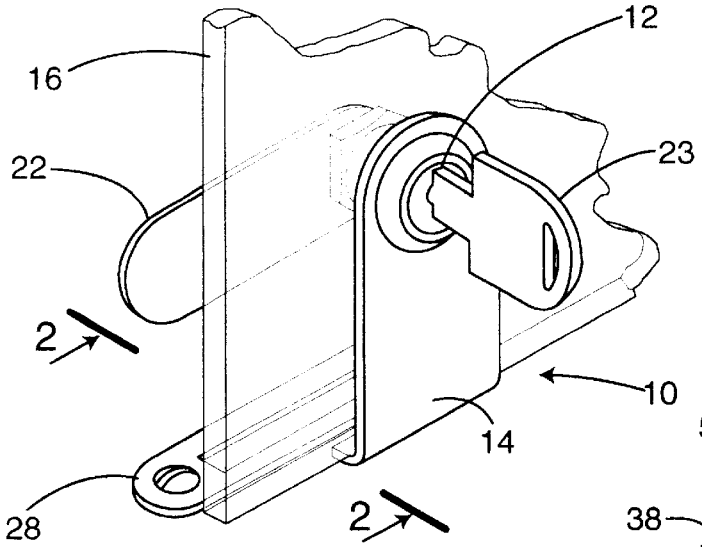
Fig. 1 (Prior Art)
FIG. 1 is a fragmentary perspective view of a prior art frameless glass door lock mounted on a door but no showing the cabinet.
Figure 4:
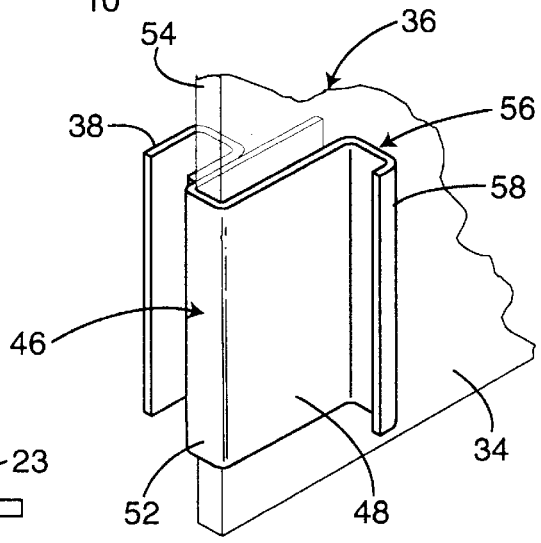
FIG. 4 is a perspective view of the lock strike/pull of the present invention mounted on a frameless glass door.
Figure 2:
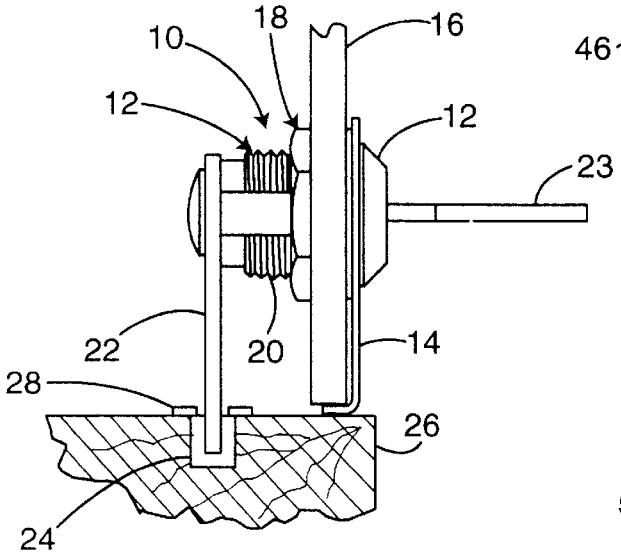
Fig. 2 (Prior Art)
FIG. 2 is a fragmentary side view taken along the line II—II of FIG. 1 and additionally showing the cabinet.

Strike/pull 36 is mounted to door 34. Strike/pull 36 includes a U-shaped bracket 46 having front plate 48, rear plate 50, and transverse web 52 connecting the front and rear plates at the ends corresponding to door edge 54. (FIG. 4.) Transverse web 52 has a width corresponding to the thickness of door 34. Front plate 48 and rear plate 50 of bracket 46 are biased toward each other to provide an inward spring force when the front and rear plates are separated to clamp the bracket about door 34. Bracket 46 is made of any suitable material having a stiffness sufficient to retain the bias of front plate 48 toward rear plate 50—and thus provide the spring force to clamp bracket 46 about door 34. Such materials include without limitation metal and plastic.

Pull portion 56 extends from front plate 48 and provides a means for allowing the operator to grasp bracket 46. As disclosed, pull portion 56 is integrally formed with front plate 48. Pull portion 56 includes handle 58, which forms a J-shaped cross section with front plate 48. Alternatively, Pull portion 56 can be attached to front plate 48 by screws, welds, glue, or other attachment means.

Figure 8:
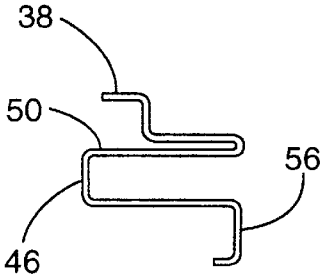
FIG. 8 is a view of an alternative embodiment of the strike/pull of the present invention.
Figure 3:
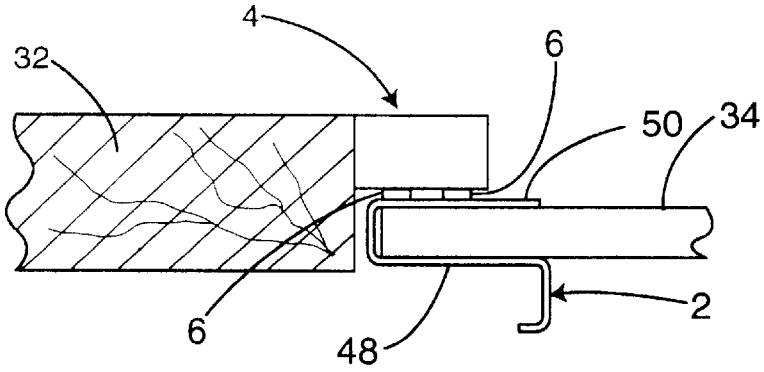
Fig. 3 (Prior Art)
FIG. 3 is a sectional view of a prior art pull mounted on a frameless glass door used in conjunction with a magnetic door stop mounted to the cabinet frame.

Lock strike 38 is attached to rear plate 50 by screws, welds, glue, or other attachment means known in the art. Lock strike 38 has a shape adequate to engage lock throw 42 to prevent the movement of door 34. For example, lock strike 38 can have a U-shaped cross section. (FIG. 4.) In another embodiment, lock strike 38 can be integrally formed with rear plate 50. (FIG. 8.)

Lock 40 is secured to cabinet frame 32 by screws 60. (FIG. 5.) Lock 40 includes lock housing 62 and lock throw 42. Keyhole 70 is formed in cabinet case 32. (FIG. 6.) Keyhole plate 78 is attached to the exterior of cabinet case 32, surrounding the exterior opening of keyhole 70. (FIGS. 6–7.) Lock 40 is a sliding bolt lock in which throw 42 "slides" or moves horizontally through lock housing 62 from a locked mode—in which lock throw 42 extends beyond the cabinet frame 32 and into the interior of lock strike 38 (FIGS. 5–6)—and an unlocked mode (FIG. 7, and FIGS. 5–6 shown in phantom lines), in which lock strike 42 extends into unlock throw recess 64 formed in cabinet frame 32. Lock housing 62 can be installed in lock housing recess 66 formed in cabinet frame 32. (FIG. 5.) The types, construction, and installation of locks suitable for use in the present invention are well known in the art.

Door stop 44 or other means for stopping door 34 is attached to cabinet case 32 to position the door in the desired closed position. (FIG. 7.) Door stop 44 is positioned on cabinet frame 32 so that lock throw 42 extends into the interior of lock strike 38 when door 34 is in the closed position and lock 40 is in the locked mode.

In an optional embodiment, block 72 (shown in phantom line) is mounted to case frame 32 to span lock housing recess 66. (FIG. 6.) Magnetic door stop 4 (shown in phantom line) can be mounted to block 72 and positioned relative to lock strike 38 to assist closure of door 34 when lock strike 38 (in this embodiment comprising ferrous metal) contacts the magnets 6 of door stop 4.

Operation

To close glass door 34, a user grasps handle 58 to push or swing the glass door so that the door contacts door stop 44. To lock the door in this closed position, the user inserts a key 74 into key hole 70 and rotates the key so that lock throw 42 moves horizontally through the lock housing 62 from the unlocked position—in which lock throw 42 extends into the throw recess 64—to the locked position—in which lock throw 42 extends into the interior of lock strike 38 (FIG. 6). Once the door is in the locked and closed position, a user attempting to open door 16 is prevented from doing so when lock strike 38 engages lock throw 42.

To open door 34 that is in the closed and locked position, the user unlocks lock 40 by rotating key 74 so that lock throw 42 extends into throw recess 64 (FIG. 6). The user can then grasp handle 58 to pull door 34—which is now unimpeded by lock strike 38—to the open position (FIG. 7).

The above descriptions are those of preferred embodiments of the invention. Various alterations and changes can be made without departing from the spirit and broader aspects of the invention as defined in the claims, which are to be interpreted in accordance with the principles of patent law, including the doctrine of equivalents.

The embodiments of the invention in which an exclusive property or privilege is claimed are defined as follows:

1. A cabinet comprising:

a cabinet case having an interior, an exterior, and an opening permitting access to said interior;

a door having front and rear faces and opposite hinged and free edges;

hinge means for hingedly mounting said hinged edge of said door to said cabinet case, wherein said door is swingable between open and closed positions on said exterior of said cabinet case;

a pull mounted about a portion of said free edge of said door, said pull having a front plate adjacent to said door front face, a rear plate adjacent to said door rear face, and a transverse web having a width corresponding to the thickness of the door and connecting said front and rear plates, wherein said front and rear plates are biased towards each other to provide an inward spring force to clamp said pull about said door, and means extending from said front plate for grasping said pull, and a lock strike attached to said rear plate and parallel to said rear plate; and a lock having a locked mode and an unlocked mode, said lock including a lock housing mounted to said cabinet case and a lock throw extending from said lock housing to lockably engage said lock strike when said door is in said closed position and said lock is in said locked mode, said lock further including an actuator accessible from said exterior of said cabinet case.

2. The cabinet of claim 1 further comprising a door stop mounted to said cabinet case, wherein said lock strike engages said door stop when said door is in said closed position.

3. The cabinet of claim 2 wherein said door stop is magnetic.

4. The cabinet of claim 1 wherein said lock throw extends horizontally from said lock housing and said pull is mounted to the vertical edge of said door.

5. The cabinet of claim 1 wherein:

said cabinet case forms a throw recess adjacent to said lock housing; and said lock throw extends into said recess when said lock is in said unlocked mode.

6. The cabinet of claim 1 wherein said lock is a sliding bolt lock.

7. The cabinet of claim 1 wherein said door is a frameless glass door.

8. The cabinet of claim 1 wherein said door is an unapertured frameless glass door.

9. The cabinet of claim 1 wherein:

said cabinet case forms a lock housing recess; and said lock housing is mounted in said lock housing recess.

10. A cabinet comprising:

a cabinet frame forming a lock housing recess and a lock throw recess adjacent to said lock housing recess;

an unapertured glass door swingingly mounted to said cabinet frame, said door having front and rear faces and an edge face between said front and rear faces;

a pull mounted to said door, said pull including a bracket clamped about a portion of said edge face of said door, said bracket having:

a front plate adjacent to said door front;

a rear plate adjacent to said door rear face;

and a transverse web having a width corresponding to the thickness of the door and connecting said front and rear plates, wherein the front and rear plates are biased toward each other to provide an inward spring force to clamp said bracket about said door; and a handle integrally formed with and extending from said front plate;

a lock strike attached to said rear plate;

a sliding bolt lock having a locked mode and an unlocked mode, said lock including:

a lock housing mounted in said lock housing recess in said cabinet frame; and a lock throw extending from said lock housing to lockably engage said lock strike when said door is in said closed position and said lock is in said locked mode and extending from said lock housing into said lock throw recess when said lock is in said unlocked mode; and a magnetic door stop mounted to said cabinet frame wherein said lock strike engages said door stop when said door is in said closed position.

11. A pull for a swingable door having an interior and an exterior comprising:

a bracket adapted to clamp about the edge of the door, said bracket having a front plate, a rear plate essentially parallel to said front plate, and a transverse web having a width corresponding to the thickness of the door and connecting the corresponding edges of said front and rear plates, said front plate, said rear plate, and said transverse web forming a first U-shaped channel opening in a first direction, wherein said front and rear plates are biased toward each other to provide an inward spring force when said bracket is positioned about the edge of the door, and said front plate is adjacent and parallel to the exterior of the door and said rear plate is adjacent and parallel to the interior of the door;

means extending from said front plate for grasping said bracket by a user; and a lock strike attached to said rear plate and parallel to said rear plate, said lock strike and said rear plate forming a second U-shaped channel opening in a second direction opposite to the first direction, whereby the pull is mountable to the door without forming a hole in the door.

12. The pull of claim 11 wherein said lock strike is integrally formed with said bracket.

13. The pull of claim 11 wherein said lock strike has a U-shaped cross section.

14. The pull of claim 11 wherein said grasping means is a handle.

15. The pull of claim 12 wherein said grasping means is integrally formed with said front plate.

16. The pull of claim 15 wherein said integrally formed grasping means forms a J-shaped cross section with said front plate.

17. A lockable cabinet, comprising:

a cabinet case including an interior and an exterior;

a door mounted to said cabinet case, said door including an interior, an exterior, a hinged edge, and a free edge;

means for hingably mounting said hinged edge of said door to said cabinet case;

a lock strike including a first U-shaped channel fitted over said free edge of said door and a second U-shaped channel, extending from said interior of said door, said first and second U-shaped channels opening in opposite directions, said lock strike further including means for grasping said lock strike extending from said exterior of said door; and a lock on said cabinet case and including a lock throw, said lock actuatable from said exterior of said cabinet case, said lock throw movable between a retracted position and an extended position wherein said throw is within said second U-shaped channel.

* * * * *